US006364126B1

(12) United States Patent
Enriquez

(10) Patent No.: US 6,364,126 B1
(45) Date of Patent: Apr. 2, 2002

(54) MAGNETIC REFRIGERATOR ORGANIZER

(76) Inventor: Robert Enriquez, 2435 Zandia Ave., Long Beach, CA (US) 90815

( * ) Notice: Subject to any disclaimer, the term of this patent is extended or adjusted under 35 U.S.C. 154(b) by 0 days.

(21) Appl. No.: 09/591,896

(22) Filed: Jun. 12, 2000

(51) Int. Cl.[7] ..... A47F 5/00

(52) U.S. Cl. ..... 211/13.1; 211/DIG. 1; 211/10; 211/45; 40/124.2; 40/600; 40/391; 248/206.5

(58) Field of Search ..... 211/DIG. 1, 13.1, 211/45, 69.1, 10; 40/124, 124.2, 600, 391; 335/285; 248/206.5

(56) References Cited

U.S. PATENT DOCUMENTS

| | | | | | |
|---|---|---|---|---|---|
| 2,924,032 | A | * | 2/1960 | Cullen | |
| 3,150,296 | A | | 9/1964 | McIntosh | |
| 3,237,327 | A | | 3/1966 | Griggs | |
| 4,100,684 | A | | 7/1978 | Berger | |
| 4,400,899 | A | * | 8/1983 | Martinez | 40/391 |
| 4,736,853 | A | | 4/1988 | O'Mara | |
| 4,852,282 | A | * | 8/1989 | Selman | 40/600 X |
| 4,912,864 | A | | 4/1990 | Price | |
| 5,274,937 | A | | 1/1994 | Birnbaum | |
| 5,295,342 | A | | 3/1994 | Roche | |
| 5,303,489 | A | * | 4/1994 | Blegen | 40/600 X |
| D349,733 | S | * | 8/1994 | Svee | 40/124 |
| 5,598,923 | A | | 2/1997 | Owens | |
| 5,743,414 | A | * | 4/1998 | Bandino | 211/69.1 |
| 5,755,338 | A | | 5/1998 | vom Braucke et al. | |
| 5,788,073 | A | | 8/1998 | Suryk | |
| 5,948,498 | A | * | 9/1999 | Bianco et al. | |
| 5,987,825 | A | * | 11/1999 | Rosen | 40/611 X |
| 6,209,734 | B1 | * | 4/2001 | Wang | 211/13.1 X |

* cited by examiner

*Primary Examiner*—Robert W. Gibson, Jr.
(74) *Attorney, Agent, or Firm*—Fulwider Patton Lee & Utecht, LLP.

(57) ABSTRACT

A time-saving display board including a magnetic backing surface for placement upon a surface such as a refrigerator door and further including a region for recording notes and the like and another region of overlapping display sleeves for selectively retaining various articles and maintaining the identification thereof.

19 Claims, 2 Drawing Sheets

MAGNETIC REFRIGERATOR ORGANIZER

BACKGROUND OF THE INVENTION

1. Field of the Invention

The invention relates generally to display boards and more specifically relates to a display board for conveniently organizing the displayed contents.

2. Description of the Prior Art

The need to display selected material such as business cards, photographs, coupons, notes, and the like on a board or panel for viewing the contents thereof has resulted in a number of attempts to provide a board that satisfactorily displays and retains such material. One such attempt can be found in U.S. Pat. No. 5,295,342 to Roche et al. Roche describes a display panel typically integrated into a wall section such as those found in removable cube walls. The board includes an exposed magnetic screen surface overlying a tack board to secure bulletins and memos by a variety of attachment means such as magnetic retention, tacking, or taping. Thus the items are positioned on the wall using either destructive pointed fasteners or magnetically retained. Such walls become cluttered as more and more material is added and often more than one fastener holds a group of materials in a stacked relationship increasing the difficulty in locating the desired information.

Another attempt to provide a display board is found in U.S. Pat. No. 5,755,338 to vom Braucke et al. This display board includes a bulletin board backing supporting at its lower end a tray including several dividers providing a number of open topped compartments for holding a variety of articles such as scissors, tape rolls, writing utensils and the like. The lower tray projects outwardly from the backing structure which has a coating providing a writing surface.

Another such device can be found in U.S. Pat. No. 3,150,296 to McIntosh. In general, such a device incorporates a magnetic backing surface, a pen clip for holding a pen or marker, a peripheral writing surface, and a holder for a memo pad. The board is placed on a metallic surface and when desired the pen is removed from its clip and notes are written upon the writing surface or accompanying note pad.

Yet another common display surface for common articles such as newspaper clippings, photographs, business cards, telephone number lists, notes, and other such writings is the refrigerator door. Typically, various sized magnets collected from random contacts with businesses are used to hold the various articles in place on the refrigerator. Often, one magnet holds more than one article and generally winds up falling on the floor along with the articles due to overloading the magnet's retention capability. The use of multiple magnets and randomly placed articles generally adds to the clutter and unpleasant appearance of one's refrigerator and does not provide a means for organizing such material. The often used practice of stacking material under one magnet also presents the viewer with a difficulty in locating the desired information.

A common shortcoming found in all of these display devices is the lack of a built-in organizational structure for the articles retained on the board such as notes, photographs, business cards and the like resulting in a general disorderly appearance and lost time while endeavoring to locate the desired item within the clutter, especially when the items are covered up by other items.

What is needed is a time-saving organizer that may conveniently mount to a refrigerator or other planar surface to organize materials placed thereon and provide a convenient system for identifying and locating such materials even if covered up.

SUMMARY OF THE INVENTION

In accordance with a preferred embodiment of the present invention, a display board is provided having a magnetic backing surface and a front surface subdivided into a first region formed with an overlying erasable surface and a second complementary region. Such second region includes a plurality of overlapping display sleeves each having an opening for insertion of selected material. Such display sleeves may include tabs for identification of the contents therein providing quick location of the desired material. A holder for a writing utensil may also be conveniently provided.

Figure 1:
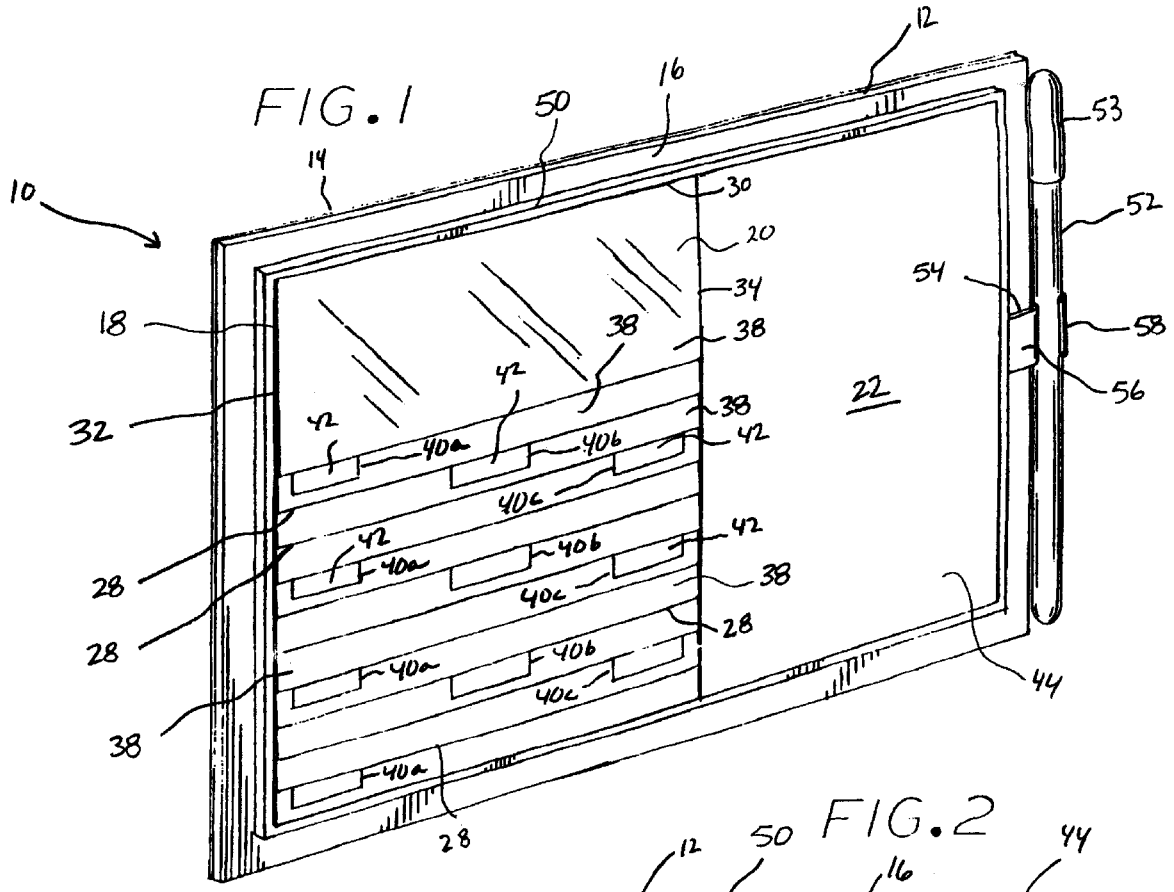
FIG. 1 perspective view of a magnetic refrigerator organizer embodying the present invention.

Numerous advantages and aspects of the invention will be apparent to those skilled in the art upon consideration of the following detailed description taken in conjunction with the drawings which generally provide illustrations of the invention in its presently preferred embodiments.

DETAILED DESCRIPTION OF THE PREFERRED EMBODIMENT

Referring now to FIGS. 1–3 and 6, a magnetic refrigerator organizer, generally designated 10, is provided for selectively arranging and identifying material in a convenient manner while providing an adjacent surface for recording desired notes. Generally, the organizer includes a display board 12 having a magnetic backing surface 14 and an opposing front surface 16 subdivided into a first region 18 with a plurality of overlapping display sleeves 20 for selectively organizing material and a complementary second region 22 for recording indicia.

Figure 6:
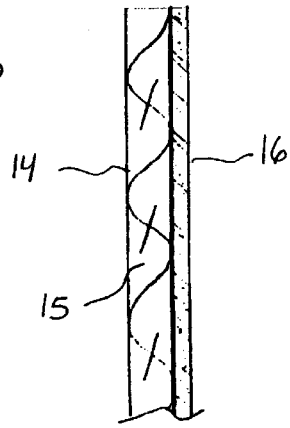
FIG. 6 is a sectional view, in enlarged scale, taken along lines 6—6 of FIG. 5.

The display board is formed from a rectangular, roughly eight and one-half by eleven inch planar board of any suitable material. The common backing surface 14 of the display board is formed from a sheet of magnetic material 15 with a sufficient attractive force to releasably retain the organizer in an upright position on a ferrous based metallic surface such as a refrigerator door (FIG. 6). Other forms of magnetic material may be incorporated such as individual strips or other suitable magnets could be formed in the backing surface. It will also be appreciated that such board may be formed of a plastic material, either vacuum formed or otherwise formed, to decrease its overall weight and facilitate mass duplication. As the backing surface primarily provides a convenient attachment surface or fastening element to other planar surfaces with complementary fastening surfaces, either portion of a velcro fastener, releasable adhesive, or hook receiving holes would also provide a suitable backing surface for the organizer. Such organizer could also be free standing and be supported by a foldout tripod stand.

Figure 2:
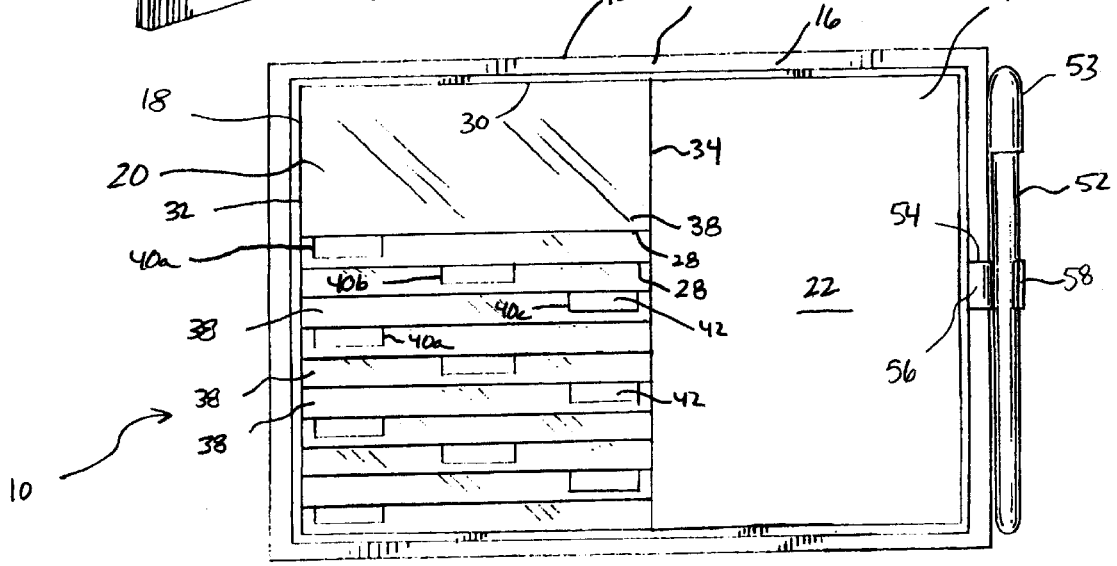
FIG. 2 is a front view, in reduced scale, of the organizer shown in FIG. 1.
Figure 4:
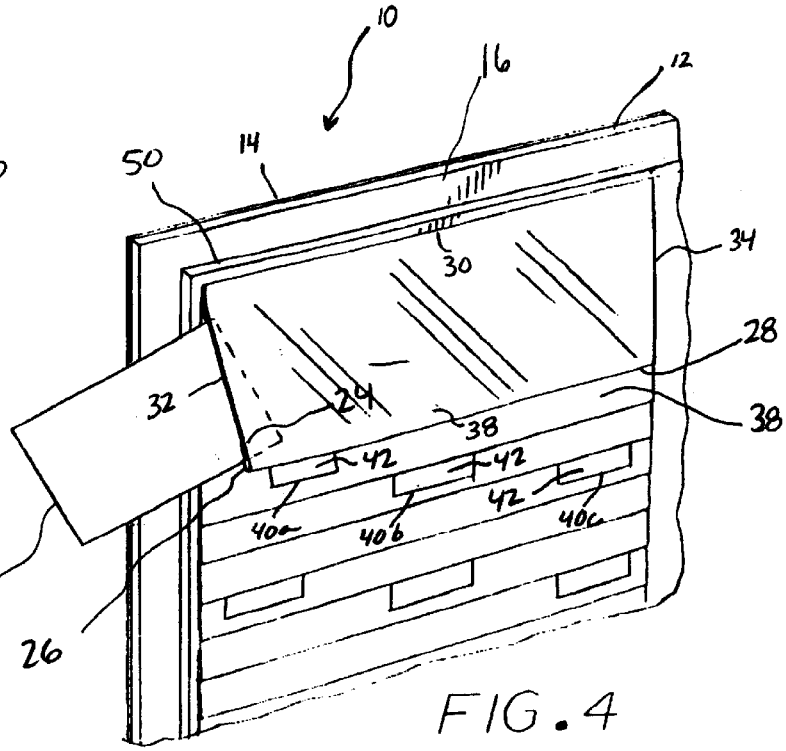
FIG. 4 is a partial perspective view of the organizer shown in FIG. 1 and illustrating the insertion of material to be selectively organized.
Figure 5:
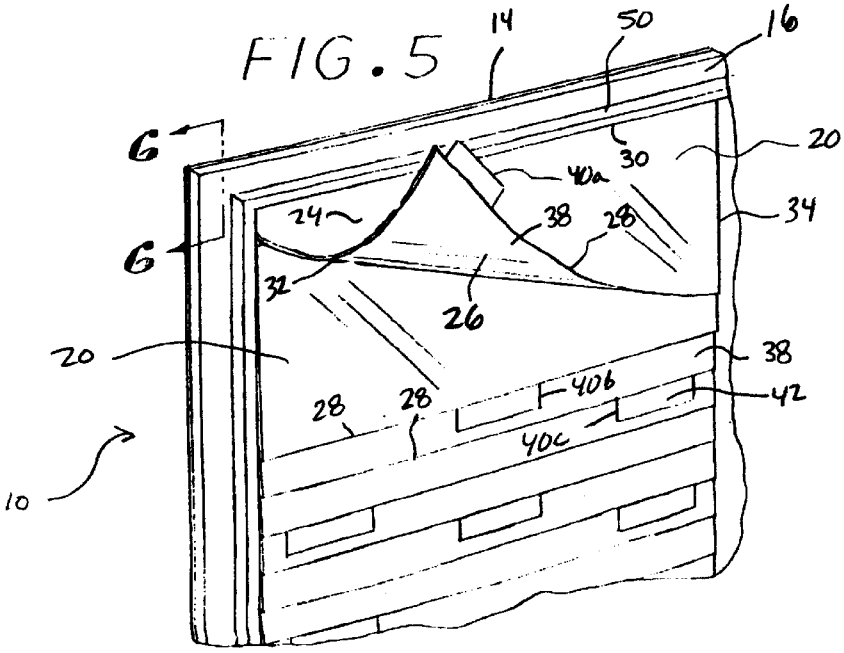
FIG. 5 is a view similar to that shown in FIG. 4 illustrating the overlapping arrangement of the display sleeves.

With continued reference to FIGS. 1 and 2, the front surface 16 of the display board overlays and is adhesively secured to the backing board 14 and is subdivided into left and right complementary regions. Overlaying and adhesively secured to the first region 18 is a plurality of overlapping, rectangular display sleeves 20. Such sleeves may be secured directly to the front surface or a backing board may be interposed between such sleeves and the front surface to facilitate the assembly and replacement of the sleeves. It will be appreciated that such sleeves may be releasably mounted to the front surface to facilitate replacement if necessary. Each individual sleeve 20 is formed from a single sheet of suitable transparent rectangular material which is folded at its midpoint to produce a front sheet 24 and a backing sheet 26 having a common lower edge 28 (FIGS. 4–5). The transparency of the sheets provides respective display windows on both the back and front of each sleeve. The sheets are sealed together at the top edge 30 to form a longitudinally projecting sleeve having open left 32 and fight ends 34 for insertion and retention of selected material 36 therebetween as illustrated in FIG. 4. The uppermost extremity of the backing sheet 26 of each sleeve forms an anchoring edge which is adhesively secured to the front surface 16 of the display board slightly offset below the top edge of the adjacent overlying sleeve.

Figure 3:
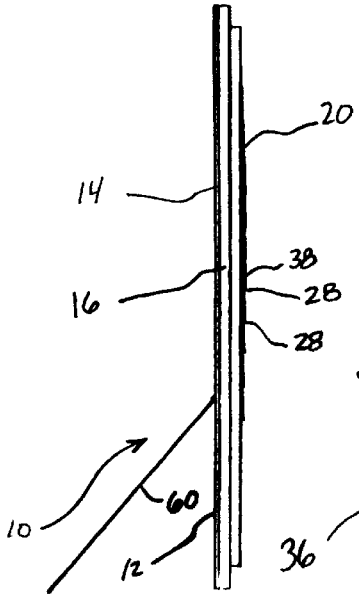
FIG. 3 is a left end view, in reduced scale, of the organizer shown in FIG. 1.

Advantageously, this mounting scheme reduces the side profile as illustrated in FIG. 3 to create a substantially flat display board 10. This is especially useful when mounted to refrigerator or cabinet doors which may be placed near a wall and thus will not interfere with opening the door. The vertically aligned sleeves 20 are arranged in a stacked and staggered relationship. This mounting arrangement also provides a conveniently exposed grasping area 38 above the bottom edge 28 of each sleeve 20. Such grasping area is convenient to grasp to flip a sleeve or group of sleeves upwardly and outwardly from the display board 10 (FIG. 5). Such exposed grasping area also provides a visual clue as to the contents 36 within the sleeve. It is anticipated that the selected materials 36 will be primarily two-dimensional objects such as business cards, coupons, photographs, and other small pieces of paper. Preferably, the four by six inch sleeve size is selected to accommodate conventional photograph and print sizes.

Conveniently, rectangular indexing tabs including a left tab 40*a*, middle tab 40*b*, and right tab 40*c* hang from the lower edge 28 of consecutive sleeves 20. The tabs on such consecutive sleeves are arranged in a staggered lateral relationship on the left, center, and right of the sleeves and provide a conveniently exposed front face 42 formed with a suitable erasable material for accepting indicia identifying the contents of the corresponding sleeve. It will be appreciated that the incorporation of such tabs with their respective visible faces accommodates quick location of the desired material 36 even if covered by one or more sleeves 20. The material selected for the front face of the tab is preferably chosen for its erasable characteristics as the contents of the sleeves may often be changed as more recent photographs or additional business cards or emergency numbers become available and are selected for insertion into one of the sleeves in the organizer.

Adjacent to the first region 18 is a spacious rectangular, second region 22 overlaying a complementary portion of the front surface 16 and measuring roughly four inches wide by eight inches high. Such region is formed with an erasable surface 44 convenient for recording notes and other indicia commonly left on a refrigerator such as grocery lists or other desired reminders. Such indicia region may also cooperate with the first region by providing a larger space for notes relating to the contents of each sleeve.

A metallic, rectangular frame 50 mounted to the display board 10 around the periphery forms an ornamental border that can receive pre-printed advertising or ornamental material to enhance the overall appearance of the display board. Such frame sandwiches the front surface 16 and backing surface 14 around their respective marginal edges and assists in securing the two surfaces together. The frame 50 also projects forwardly from the front surface 16 of the board such that the first region and second regions are recessed from the foremost edge of the frame.

Conveniently, a writing utensil 52 such as a dry-erase marker with a conventional cap 53 is releasably retained within a clip 54 at the right hand edge of the display board 10, as viewed in FIG. 2. The clip is formed with an elongated mounting arm 56 secured to the frame by an adhesive or other suitable means which terminates in a channel shaped, utensil retaining clamp 58. The writing utensil 52 may be placed between opposing clamp legs which compress the sides of the marker 52 to retain it therebetween until removal is desired. Such clamp is preferably formed of a resilient material capable of repeated use over a long period of time. Such marker is preferably placed proximate the second region 22 where it will be used more frequently.

In operation, the user places the board 10 with the magnetic backing surface 14 against a metallic surface such as a refrigerator door positioned upright as shown in FIG. 2. If another backing surface having a fastener complementary to the mounting surface fastener is used, it is merely positioned to align both fasteners and positioned against to releasably retain the board to the desired mounting surface. To place material into one of the overlapping sleeves 20, the user will select the desired sleeve by grasping the conveniently exposed lower grasping area 38 or corresponding tab 40*a*, 40*b*, or 40*c* and separating the front and back plastic sheets 24 and 26 enlarging the opening 32 (FIG. 5). The selected material 36 such as a business card or photograph is inserted between the separated sleeve sheets from the left side as viewed in FIG. 4. Other material may be selected for placement in the same or alternative sleeves in a like manner. If the user desires to record any notes onto the erasable surface 44, the user removes the conveniently provided marker 52 from its clip 54 and upon removing the cap 53, may write the desired message in the second region. The user may also record information on the tabs 40*a*, 40*b*, 40*c* to identify the contents in the associated sleeve in a like manner. When desired, the user may quickly read the contents of the tabs and flip straight the corresponding sleeve and view or remove the corresponding contents.

It will be appreciated that the display sleeves 20 may be oriented differently than shown in FIGS. 1 and 2 without detracting from the scope and spirit of the present invention. Such sleeves may be oriented horizontally such that their respective adjacent grasping areas 38 are laterally spaced with respect to one another. The sleeves are formed with sufficient rigidity in such orientation to project laterally and lay substantially flush on said display board. The complementary regions 18 and 22 maybe upper and lower divisions to vertically align the sleeves with the erasable surface 44. Alternatively, such sleeves may be interposed between said erasable surface or vice-versa.

From the foregoing, the organizational system of the present invention provides a utility not previously available in other display boards. It will appreciated that a plurality of sleeves provides sufficient space for storing a large quantity of material to reduce the clutter caused by multiple magnets and pieces of paper. The incorporation of tabs facilitates rapid location of the desired information even when covered by another sleeve. The erasable surface on the tabs facilitates changing identification of the sleeve contents which will most likely change frequently as new photographs, business cards, and the like are obtained.

It will further be appreciated that while this organizer is particularly useful in organizing and mounting to planar surfaces such as refrigerator or cabinet doors, or cubicle walls, a free-standing version may also be incorporated. Preferably, such free standing organizers would incorporate an extension 60 that is preferably pivotally attached to the backing of the organizer (FIG. 3). This would allow the extension to nest flat against the back surface of the organizer when not in use or pivot away from the back surface of the organizer to project outwardly and downwardly to rest against a flat surface so that its lowermost edge lies either in the same plane as the lower edge of the organizer or parallel thereto. Such pivoting extension may also be used in conjunction with any of the fasteners or mounting features described herein to give the organizer more versatility with respect to placement.

While several forms of the present invention have been illustrated and described, it will also be apparent that various modifications may be made without departing from the spirit and scope of the invention. Furthermore, while the preferred embodiment of the invention has been described in terms of the dimensions and cross-sectional configurations of various components of the invention it is understood that the invention is not intended to be limited to those specific dimensions or configurations but is to be accorded the full breadth and scope of the claims appended hereto.

What is claimed is:

1. A magnetic refrigerator organizer comprising:

a display board having a backing surface including magnetic material for adhering to ferrous based surfaces and having a front surface with a first display region and an adjacent second display region;

a plurality of elongated, planar display sleeves arranged in a stacked and staggered relationship and mounted on their respective one edges from said front surface within said first region, said sleeves including respective openings for insertion of selected material and being positioned in an overlapping arrangement so the respective edges opposite the respective said one edges are exposed for grasping; and an erasable surface overlying said second region for receiving indicia.

2. The organizer as set forth in claim 1 wherein:

said sleeves are formed with respective said openings formed on at least one lateral side of the respective said sleeves.

3. The organizer as set forth in claim 1 further including:

identification tabs projecting from the respective said sleeves.

4. The organizer as set forth in claim 3 wherein:

each tab on adjacent sleeves is offset from one another.

5. The organizer as set forth in claim 1 further including:

a clip mounted to said display board and a writing utensil releasably retained therein.

6. The organizer as set forth in claim 1 wherein:

said display board is the form of a substantially eight and one-half inch by eleven inch rectangle.

7. The organizer as set forth in claim 1 wherein:

said sleeves are formed of a transparent plastic material.

8. The organizer as set forth in claim 1 wherein:

said sleeves are substantially four inches high by six inches long.

9. The organizer as set forth in claim 1 further including:

a frame peripherally mounted to said board and bordering said first and second regions.

10. The organizer as set forth in claim 1 wherein:

said sleeves are oriented horizontally and positioned in vertical alignment with said erasable surface and being sufficiently rigid to project laterally and remain flush to said board to dispose said respective edges opposite said one edges laterally adjacent to one another.

11. The organizer as set forth in claim 1 wherein:

said front surface is a one piece continuous board.

12. The organizer as set forth in claim 1 further including:

a backing board interposed between said sleeves and said front surface.

13. A magnetic organizer for identifying and displaying selected material comprising:

a common backing structure having a magnetic back side and a front display side;

a recording area disposed on a portion of said front side and having an erasable coating for receiving indicia;

an organizational storage area disposed on a complementary portion of said front side and including a plurality of overlapping clear plastic sleeves including at least one opening disposed along an edge thereof for insertion of selected materials and a lower exposed gripping region for lifting said sleeve outwardly from said front display side;

a plurality of identification tabs depending from each sleeve, said tabs being offset from another such tab on an adjacent sleeve;

a frame sandwiching said front and back sides along their respective marginal edges and bordering said recording and organizational areas;

a utensil holder mounted to said frame; and a writing utensil releasably retained in said utensil holder whereby said display board may be mounted on a planar surface and selected material may be inserted through said opening into a preselected sleeve and said utensil may be removed from said utensil holder to record selected identification on said tab corresponding to the contents of said sleeve and also record additional information within said recordation area for display.

14. An organizer for identifying and displaying selected material on a planar surface for placement over a portion of a support surface including a first fastening element and comprising:

a display board having a backing surface including a second fastener element to be complementally received against the first fastening element for releasable fastening thereto, said display board including an opposing front surface with a first display region and an adjacent second display region;

a plurality of elongated, display sleeves arranged in an overlying and staggered relationship for mounting adjacent to one another, each of said sleeves including four sides with at least one sleeve opening formed in one of said sides and at least one display window, one of said sides being formed with an anchoring edge mounted from said front surface within said first display region in offsetting relationship with respect to at least one adjacent sleeve and an opposing free edge projecting below an overlying sleeve to form a hand grasp; and an erasable surface overlying said second region for receiving indicia.

15. An organizer as set forth in claim 14 wherein:

said respective anchor edges are releasably mounted to said front surface.

16. An organizer as set forth in claim 14 further including:

identification tabs projecting from said sleeves.

17. Method for organizing a desired amount of inserts and viewing the respective contents on a planar surface including a first fastener element comprising the steps of:

providing a display board with a backing surface including a second fastener element to be complementally received against the first fastening element for releasably fastening thereto, said display board having an opposing front surface with a first display region and an adjacent second display region, said display board further including a plurality of elongated, planar, transparent, display sleeves arranged in an overlying and staggered relationship, and mounted on their respective one edges from said front surface within said first display region, said sleeves including respective openings for insertion of selected material and being positioned in overlapping arrangement so the respective opposing free edges project below an overlying sleeve to form an exposed hand grasp, said display board further including an erasable surface covering said second region for receiving indicia;

positioning said second fastener element against the first fastener element to releasably fastening said display board to said planar surface;

selecting an insert to be organized;

inserting said selected insert into a desired display sleeve through said respective opening;

repeating said selecting and inserting steps as necessary to organize the desired amount of inserts; and grasping an exposed hand grasp of an overlying sleeve directly above an underlying sleeve and lifting said overlying sleeve to view an insert inserted in said underlying sleeve.

18. An apparatus for organizing a desired amount of inserts on a planar surface including a first fastener element comprising:

a frame including a backing surface having a second fastener element to be complementally received against the first fastening element for releasably fastening thereto, said display board including an opposing front surface with a mounting section and a flanking indicia section of a predetermined area, a display packet including a plurality of elongated, planar display sleeves of a predetermined size arranged in an overlying and staggered relationship, each of said sleeves suspended vertically downwardly from an upper extremity mounted to said display board within said mounting section in an offsetting relationship to at least one adjacent sleeve and an opposing lower extremity being spaced vertically above a lowermost extremity of an underlying sleeve to form an exposed handle, each of said sleeves further formed with a front panel defining a transparent window and at least one open end for insertion of the inserts;

an indexing tab suspended from the lower extremity of each sleeve having a forwardly facing indicia receiving surface and arranged in a horizontally staggered relationship to other of said indexing tabs;

an erasable surface overlying said indicia section; and a marking utensil releasably attached to said frame for marking indicia on said erasable surface and said indexing tabs.

19. A free-standing organizer for placement on a support surface and organizing a desired amount of inserts comprising:

a display board having a backing surface including an extension projecting downwardly and outwardly therefrom to engage said support surface so that said display board rests in a substantially upright position when placed thereon, said display board including an opposing front surface with a first display region and an adjacent second display region;

a plurality of elongated, display sleeves arranged in an overlying and staggered relationship for mounting adjacent to one another, each of said sleeves including four sides with at least one sleeve opening formed in one of said sides and at least one display window, one of said sides being formed with an anchoring edge mounted from said front surface within said first display region in offsetting relationship with respect to at least one adjacent sleeve and an opposing free edge projecting below an overlying sleeve to form a hand grasp; and an erasable surface overlying said second region for receiving indicia.

* * * * *

UNITED STATES PATENT AND TRADEMARK OFFICE

CERTIFICATE OF CORRECTION

PATENT NO. : 6,364,126 B1
DATED : April 2, 2002
INVENTOR(S) : Enriquez

It is certified that error appears in the above-identified patent and that said Letters Patent is hereby corrected as shown below:

Title page,
Item [*] Notice, delete the phrase "by 0 days" and insert -- by 28 days --

Signed and Sealed this

Twenty-eighth Day of September, 2004

JON W. DUDAS
*Director of the United States Patent and Trademark Office*